US005534832A

United States Patent [19]

Duchemin et al.

[11] Patent Number: 5,534,832

[45] Date of Patent: Jul. 9, 1996

[54] SWITCH

[75] Inventors: Pierre Duchemin, Fouqueux; Gilles Baurand, Montesson la Borde; Dominique Leglaye, Rueil Malmaison, all of France

[73] Assignee: Telemecanique, Rueil Malmaison, France

[21] Appl. No.: 558,934

[22] Filed: Nov. 13, 1995

Related U.S. Application Data

[63] Continuation of Ser. No. 217,868, Mar. 25, 1994, abandoned.

[30] Foreign Application Priority Data

Mar. 25, 1993 [FR] France ..... 93 03562
Sep. 24, 1993 [FR] France ..... 93 11481

[51] Int. Cl.[6] ..... H01H 75/00

[52] U.S. Cl. ..... 335/16; 335/147; 335/195; 218/22

[58] Field of Search ..... 335/16, 147, 195; 218/22

[56] References Cited

U.S. PATENT DOCUMENTS

| | | | |
|---|---|---|---|
| 3,238,329 | 3/1966 | Russo . | |
| 4,649,247 | 3/1987 | Preuss et al. | 335/195 |
| 4,916,421 | 4/1990 | Pardini et al. | 335/195 |

FOREIGN PATENT DOCUMENTS

| | | |
|---|---|---|
| 0079819 | 5/1983 | European Pat. Off. . |
| 0314540 | 3/1989 | European Pat. Off. . |
| 2110421 | 2/1972 | France . |

*Primary Examiner*—Lincoln Donovan
*Attorney, Agent, or Firm*—Oblon, Spivak, McClelland, Maier & Neustadt

[57] ABSTRACT

A switch having at least one power switching pole includes a contact bridge cooperating with fixed contacts and adapted to be maneuvered either by mobile parts of a solenoid or by a tripping mechanism. The contact bridge is rotatable and the mobile parts of the solenoid operate the contact bridge through the intermediary of a transmission mechanism.

21 Claims, 4 Drawing Sheets

SWITCH

This application is a Continuation of application Ser. No. 08/217,868, filed on Mar. 25, 1994, now abandoned.

BACKGROUND OF THE INVENTION

1. Field of the Invention

The present invention concerns a switch having at least one power switching pole comprising a contact bridge cooperating with fixed contacts and maneuverable by the mobile parts of a solenoid.

2. Description of the Prior Art

The various switches (contactors, contactor/circuit-breakers, protection relays) have the arrangement defined above. The power switching poles each comprise two fixed contacts connected to connecting terminals and a mobile contact bridge which forms a bridge between the fixed contacts in the closed position. Each contact bridge is mounted on a contact-holder.

Contactor/circuit-breakers use the same power poles for the circuit-breaker, contactor and thermal overload relay functions. Each contact bridge can be operated by a solenoid (contactor function), by a striker (short-circuit protection), by a thermal and/or magnetic protection module (protection against overload, phase imbalance and overcurrent) operating on the tripping mechanism.

In some contactor/circuit-breakers the contacts of each power switching pole are accommodated in an insulative cartridge providing insulation between the poles and forming the interrupter chamber. Each contact-holder moves in translation and is spring-loaded by a compression spring bearing against the back of the cartridge and urging the contacts towards their closed position. The tripping mechanism and the solenoid are mechanically independent of the contact-holder and actuate it separately. To keep the contacts open, the solenoid or the striker mechanism must overcome the force of the compression spring.

An aim of the present invention is to provide a switch in which the contact bridge rotates and is operated by the solenoid. The pole pressure springs operating on the mobile contacts are on the mobile contact-holder. The use of rotating contact bridges achieves faster switching. Because there is no compression spring bearing against the bottom of the cartridge, the switches can have high ratings and advantageous drive systems. The cartridges can be replaced easily and without rewiring. The switching speed can be controlled with the present invention. The design of this switch can be adapted to various versions: contactors, contactor/circuit-breakers, isolators.

SUMMARY OF THE INVENTION

According to the invention, the contact bridge is rotatable and the mobile parts of the solenoid actuate said contact bridge through the intermediary of a transmission mechanism.

According to one feature of the invention the rotatable contact bridge is mounted in a cartridge forming an interrupter chamber.

According to one feature of the invention each cartridge has a crank for driving the contact bridge extending outside the envelope of said cartridge and is connected by the transmission mechanism to the mobile parts of the solenoid.

According to one feature of the invention the switch includes means for mechanically coupling the mobile contact-holder and a tripping mechanism and means for mechanically coupling the contact-holder to the mobile parts of the solenoid, said means enabling independent coupling of the tripping mechanism or the mobile parts of the solenoid to said contact-holder to enable independent operation in contactor or circuit-breaker mode.

The invention is described in more detail with reference to specific embodiments of the invention shown by way of example in the appended drawings.

DETAILED DESCRIPTION OF THE PREFERRED EMBODIMENTS

Figure 1:
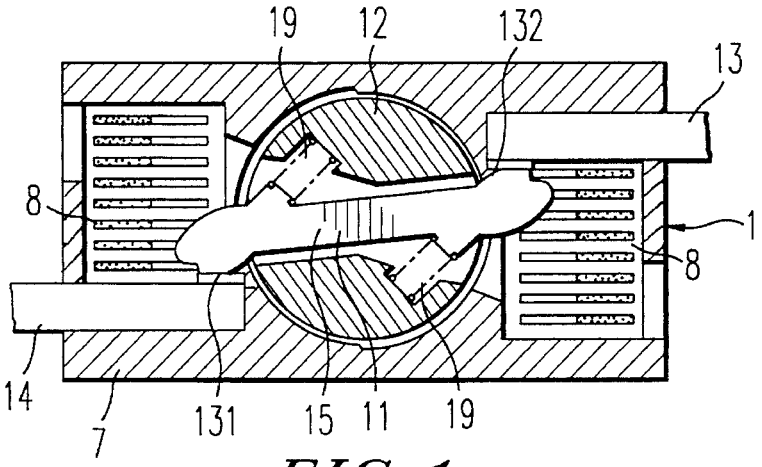
FIG. 1 is a diagram showing a cartridge used in a switch according to the invention.
Figure 9:
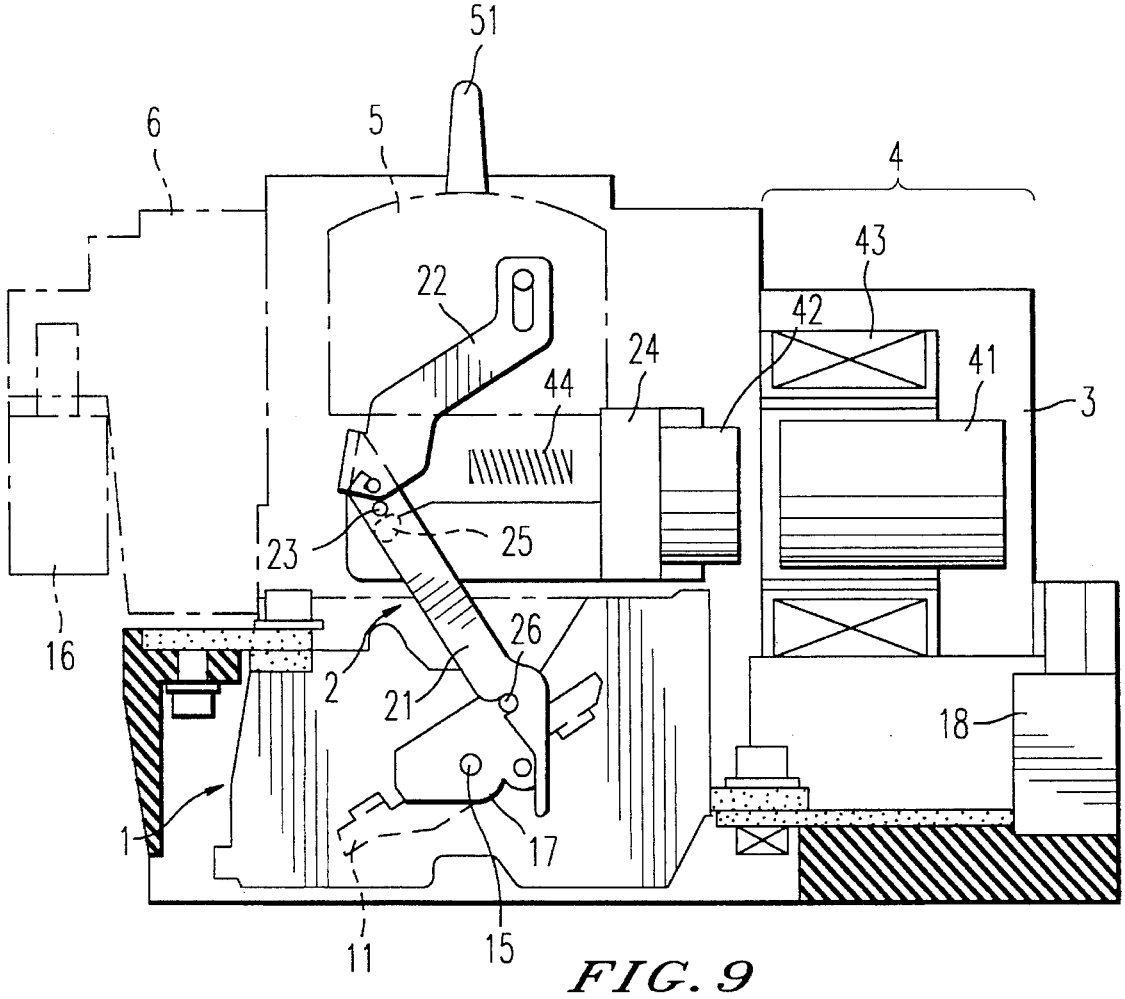
FIG. 9 is a diagram showing a contactor/circuit-breaker according to the invention.
Figure 2:
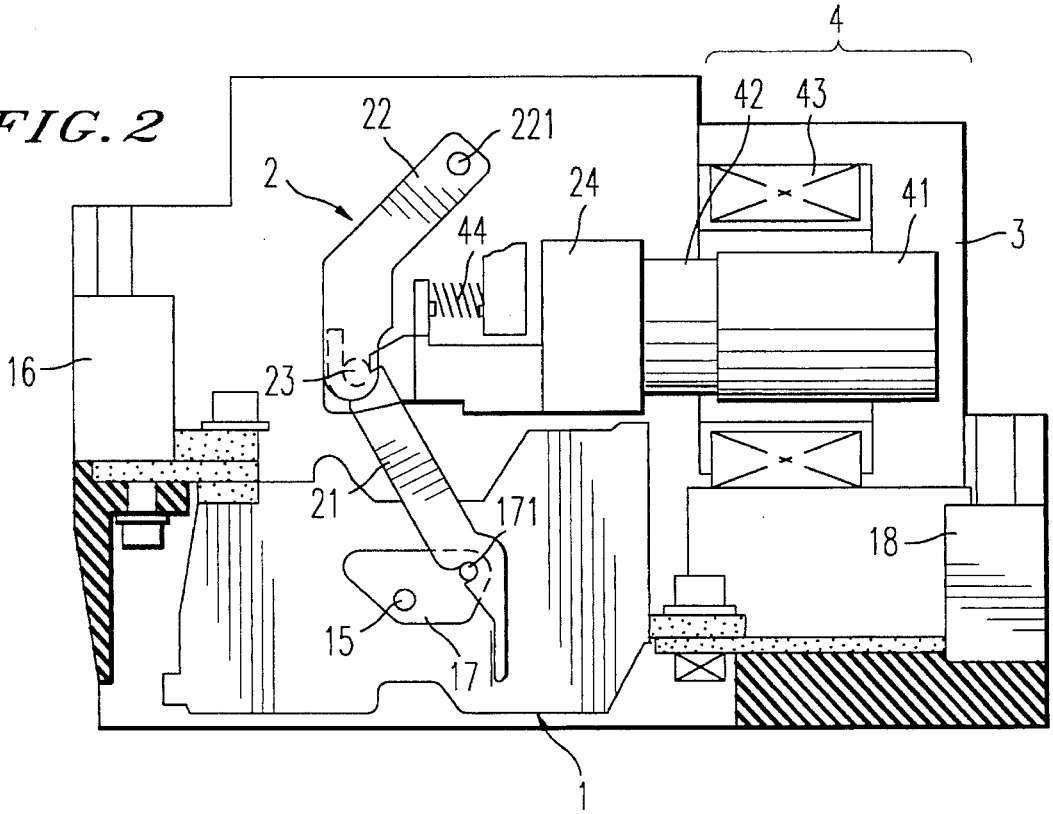
FIG. 2 is a diagram showing a first embodiment of a contactor according to the invention.
Figure 3:
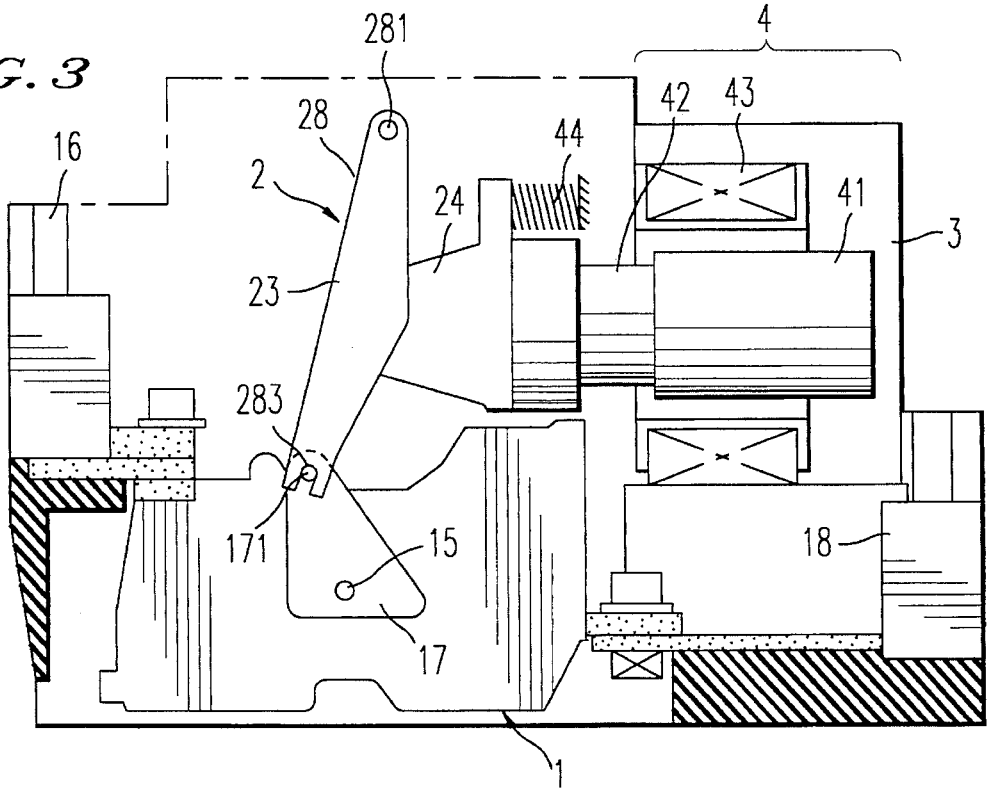
FIG. 3 is a diagram showing a second embodiment of a contactor according to the invention.

The switch shown in the drawings comprises a plurality of twin-contact power switching poles. FIGS. 2, 3 and 9 show one pole only.

Each power switching pole comprises a set of fixed contacts 13 and 14 connected to respective connecting terminals 16 and 18 and a mobile contact bridge 11 carrying contact pads and cooperating with fixed contacts 131 and 132 to establish or interrupt flow of current between the terminals. This is therefore a twin-contact arrangement. The two connecting terminals 16, 18 are screw terminals for connecting electrical conductors, for example.

The contact bridge 11 is mounted on a contact-holder 12 made from an insulative material and rotatable about a pivot 15. The central part of the contact bridge 11 is accommodated in a housing of the contact-holder 12 so that it can pivot relative to the contact-holder, the relative pivoting movement being delimited by abutments. Springs 19 are mounted between the contact bridge 11 and the contact-holder 12 to provide the contact pressure.

The pivoted contact-holder 12 is fastened to a drive crank 17 rotated by the solenoid 4 through the intermediary of the transmission mechanism 2.

The contacts of each power switching pole are contained in an insulative cartridge 1 providing the insulation between poles and forming the interrupter chamber. The various cartridges 1 are held side by side in a row in a casing 3 accommodating the solenoid 4 which operates the contacts.

Each cartridge 1 includes a molded plastics material exterior casing 7. It contains the contact bridge 11 and the contact-holder 12 which pivots about the pivot 15 between the contacts open position and the contacts closed position. The contact-holder 12 exits one side of the casing and is fastened to the drive crank 17. The pivot 15 is substantially equidistant from the two mobile contacts, the contact bridge 12 extending to either side of the pivot axis. The various cranks 17 are parallel and are pivoted by the mobile parts of the solenoids. The cartridges 1 contain de-ionizing fins 8.

The casing enables the contactor to be mounted either on a rail by means of a cut-out provided with attachment means or on a panel by means of lugs at the side incorporating fixing holes.

The solenoid 4, which moves the mobile contacts, comprises a fixed magnetic circuit 41, a mobile magnetic circuit 42 adapted to move in rectilinear translation and a coil 43. The coil 43 has supply terminals which are accessible from outside the casing. A return spring 44 associated with the solenoid urges the mobile magnetic circuit 42 towards the contacts open position.

In the contactor shown in FIG. 2 each drive crank 17 of a rotary-contact holder is coupled to a fixed point 221 by a toggle lever made up of two links 21 and 22 articulated about a pivot 23. The link 22 is articulated to the fixed point 221 and the link 21 is connected to the drive crank 17 by a demountable articulated coupling about a pivot 171. The pivot 23 of the toggle lever is connected to the mobile part of the solenoid. The displacement of the mobile parts of the solenoid pivots the cranks 17.

In the contactor shown in FIG. 3 each drive crank 17 of a rotary contact-holder is articulated to a link 28 pivoting about a fixed pivot 281 and pivoted by the mobile parts of the solenoid. The link 28 and the lever 17 pivot about a pivot 171 which is removable. The mobile parts of the solenoid are connected by an articulated coupling 23 to the pivoting link 28.

Figure 5:
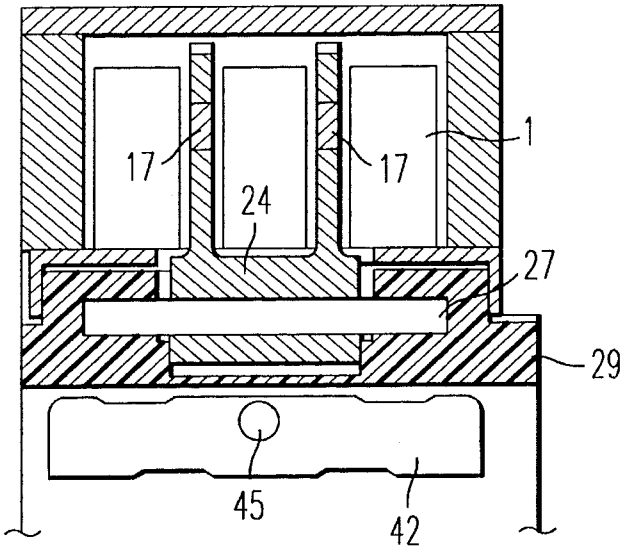
FIG. 5 is a view in cross-section on the line V—V in FIG. 4.
Figure 4:
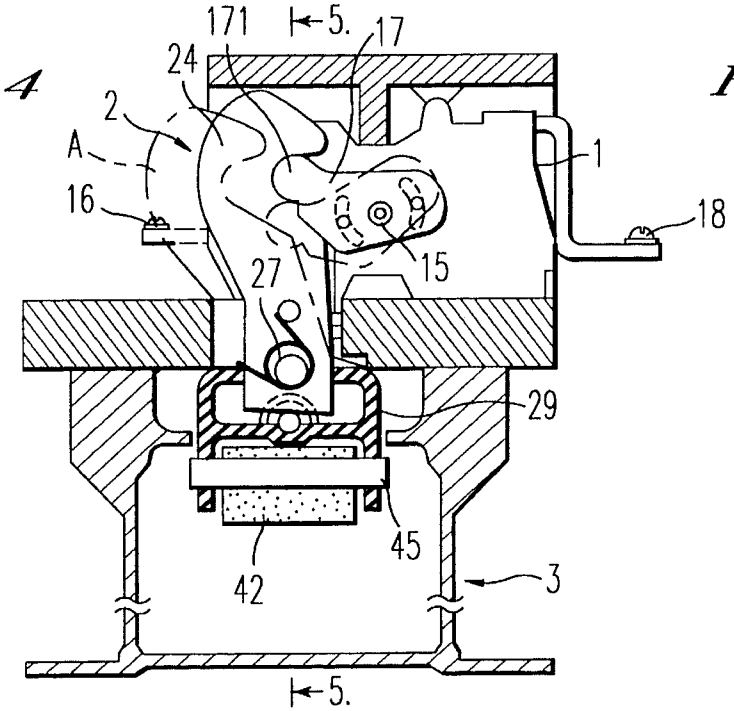
FIG. 4 is a diagram showing a third embodiment of a contactor according to the invention.

In the contactor shown in FIGS. 4 and 5 each drive crank 17 is connected by a demountable articulated coupling 171 to a link 24 actuated by the mobile parts of the solenoid. The articulated coupling 171 between the crank 17 and the link 24 has cylindrical bearing surfaces which resemble a hook and enable easy demounting. The articulated coupling between the link 24 and the mobile parts is of the ball-joint type and is provided by a cage 29 connected by orthogonal pivots 27 and 45 to the link 24 and to the mobile magnetic circuit 12 of the solenoid, respectively. A spring acts on the link 24 to urge the articulation bearing surfaces of the link against the conjugate articulation bearing surfaces of the crank 17.

Figure 8:
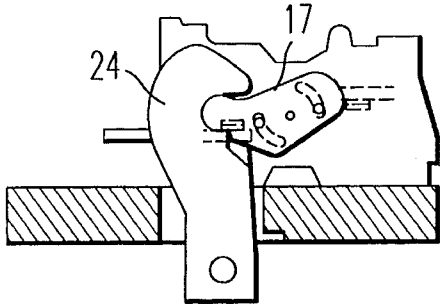
FIGS. 6, 7 and 8 show the operation of the contactor from FIGS. 4 and 5.
Figure 7:
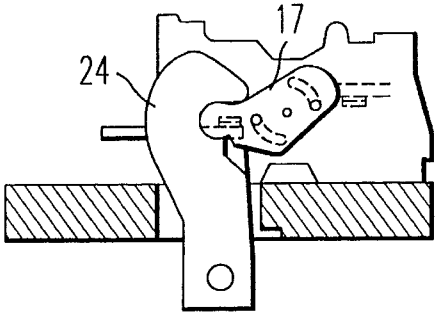

The operation of the contactor shown in FIG. 4 and 5 is now described with reference to FIGS. 6 through 8.

Figure 6:
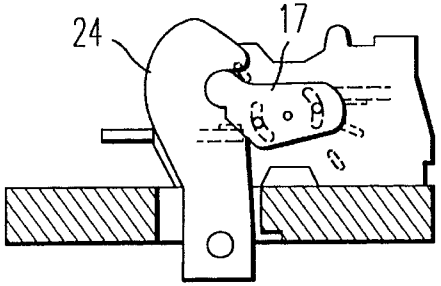

In the open position shown in FIG. 6 the armature of the solenoid is held away from the yoke by the spring associated with the solenoid. The contact bridges of the various cartridges are then in the open position.

Excitation of the solenoid coil pulls down the mobile magnetic circuit causing translation movement of the link 24 and rotation of the cranks 17. The contacts of each bridge 11 bear against the fixed contacts connected to the connecting terminals (FIG. 7). The springs inside the cartridges press the mobile contacts against the fixed contacts (FIG. 8).

The contactor/circuit-breaker shown in FIG. 9 has a tripping mechanism 5 inside the casing. The drive crank 17 of each rotary contact-holder 12 of a pole is connected to the tripping mechanism 5 by a toggle lever made up of two links 21 and 22 articulated together at a pivot 23. The link 22 is mechanically connected to the tripping mechanism 5 and the link 21 is connected to the drive crank 17.

The drive crank 17 of the rotary contact-holder 12 is mechanically connected to the mobile magnetic circuit 42 of the solenoid. To this end the toggle lever pivot 23 is mechanically connected to the mobile magnetic circuit 42 of the solenoid by an articulated and sliding coupling 25 and a link 24. The link 24 is connected at one end to the pivot 23 by the articulated and sliding coupling 25 and at the other end to the mobile armature 42. It is guided for translatory movement.

The toggle lever link 21 is articulated at 26 to the crank 17. The toggle lever link 22 is connected to the tripping mechanism 5 which moves it. The coupling 26 between the link 26 and the crank 17 is demountable.

The articulated and sliding coupling 25 is made up of a slideway 25 formed in the link 24 and in which the toggle lever pivot 23 slides. This slideway is open to enable release of the pivot 23 and the assembly carrying the tripping mechanism 5 and the mechanism 2 for demounting them.

The articulated and sliding coupling 25 is designed to allow no freedom of movement to the pivot 23 in contactor mode and to allow some freedom of movement to the pivot 23 in circuit-breaker mode.

The slideway 25 is advantageously open to enable release of the pivot 23 and therefore demounting of the assembly.

The contactor/circuit-breaker of FIG. 9 comprises a magnetic and thermal protection module 6 having on each current path an instantaneous action magnetic device to protect against high overcurrents and a thermal device to protect against overloads and phase imbalances. If the protection module detects an overload or an overcurrent on the current path it operates on the contact-holder through the intermediary of the tripping mechanism 5.

All manual and automatic control action passes through the tripping mechanism 5 which operates mechanically on a contact in series with the coil 43 of the solenoid. The tripping mechanism 5 can be operated manually by a control button 51 or automatically on instructions issued by the protection module 6. The various states of the mechanism are indicated by the position of the control button 51.

The operation of the contactor/circuit-breaker is described next.

Figure 10:
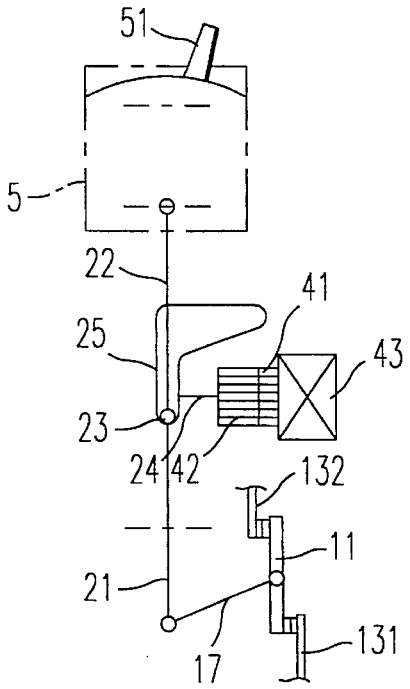
FIG. 10 is a diagram showing the contactor/circuit-breaker in a condition in which the tripping mechanism is armed and the solenoid coil is energized, which closes the poles (contactor function)
Figure 11:
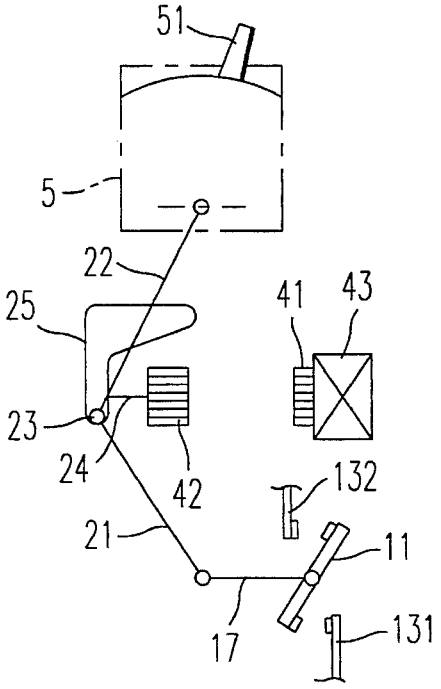
FIG. 11 is a diagram showing the contactor/circuit-breaker in a condition where the tripping mechanism is armed and the solenoid coil is not energized, which opens the poles (contactor function)

In FIGS. 10 and 11 the tripping mechanism 5 is armed. If the coil 43 is energized, the solenoid 4 is closed and places the toggle lever 21-22 in the deployed position (FIG. 10). The toggle lever pivots the drive crank 17 and the associated contact bridge 11 so that the poles close. The pressure springs in the contact-holder 12 press the bridge 11 against the fixed contacts.

If the coil is not or no longer engergized the mobile magnetic circuit 42 and the link 24 move the toggle lever 21-22 to the folded position. This folding of the toggle lever 21-22 pivots the contact bridge 11 and opens the poles (FIG.

11). This opening action is achieved by action on the control circuit of the coil, i.e. the normal contactor function. In FIGS. 10 and 11 the tripping mechanism is armed and there is a positive connection between the sliding coupling 25 and the pivot 23.

Figure 12:
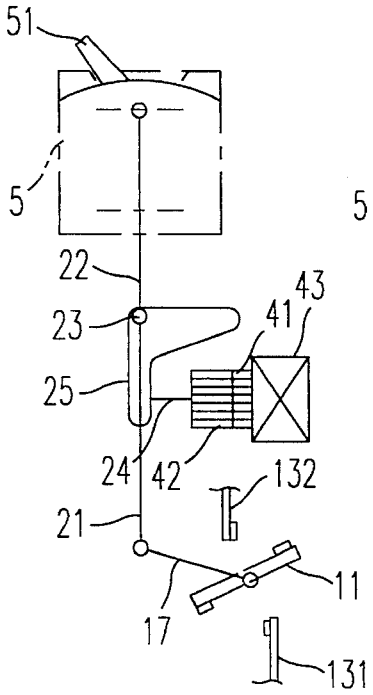
FIG. 12 is a diagram showing the contactor/circuit-breaker in a condition in which the tripping mechanism is tripped, which opens the poles (circuit-breaker function)
Figure 13:
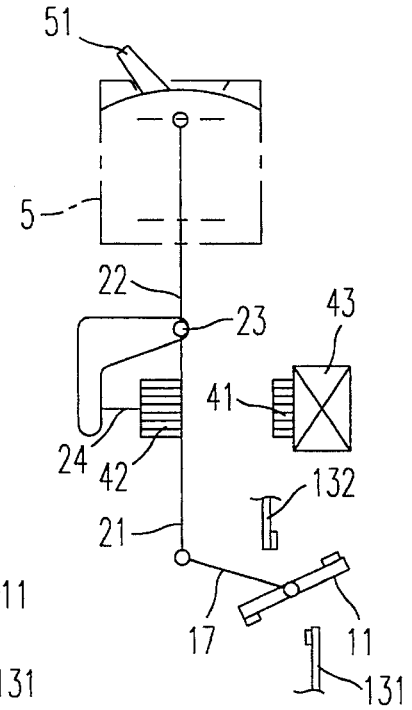
FIG. 13 is a diagram showing the contactor/circuit-breaker in a condition in which the tripping mechanism is tripped, the poles are open and the solenoid is open.
Figure 14:
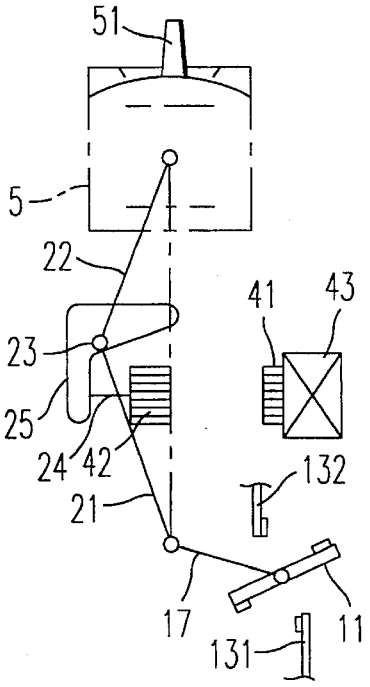
FIG. 14 is a diagram showing the contactor/circuit-breaker during rearming, the solenoid remaining open.

From the contacts closed position shown in FIG. 10, contact opening can come about either as previously described or in response to a short-circuit or an overload. In this case the tripping mechanism 5 is tripped (FIG. 12) and displaces the toggle lever 21-22. This pivots the contact-holder 11 and the contacts open. From this position onwards the coil is no longer energized and the solenoid opens (FIG. 13). The opening of the solenoid has no effect on the contacts because there is no longer any positive connection between the sliding coupling 25 and the pivot 23.

The links 21-22 constituting the toggle lever have different relative positions when deployed depending on the contact force and speed required, according to the operating speed of the solenoid.

To re-arm the device the operator uses the button 51 to fold the toggle lever 22-21. The solenoid remains open.

To change the cartridges 1 the link 21 and the lever 17 are uncoupled by tilting the link 21. The assembly containing the tripping mechanism 5 and the toggle lever 21-22 can then be released. It is then a simple matter to change the cartridges 1.

In all the embodiments the demountable couplings between the levers 17 and the transmission mechanism enable demounting and replacement of the cartridges 1. Also, the conductor portions housed in the cartridges can be separated from the conductor portions going to the terminals 16 and 18.

It is to be understood that without departing from the scope of the invention variants and improvements can be made and even equivalent means substituted.

In the case of a protection relay version of the switch, a thermal protection module is added to the contactor.

The cartridges 1 can be at the rear, front or side of the switch. The lever arms can be adapted accordingly.

There is claimed:

1. A switch having at least one power switching pole comprising:

a contact holder bearing a contact bridge;

said contact bridge cooperating with fixed contacts and being fastened to a drive crank;

wherein springs are mounted between said contact bridge and said contact holder to provide the contact pressure for the closing position of contacts and to induce no return force for the opening position of contacts;

and wherein a transmission mechanism driven from an electromagnet or a tripping mechanism and adapted to operate on said drive crank for causing said contact bridge to move.

2. The switch according to claim 1 wherein said contact bridge is mounted in a cartridge forming an interrupter chamber.

3. The switch according to claim 2 wherein said cartridge has a contact bridge drive crank exiting said cartridge and coupled by said transmission mechanism to mobile parts of said solenoid.

4. The switch according to claim 3 wherein said contact bridge crank is mechanically connected to a toggle lever and wherein, said mobile parts of said solenoid operate on the toggle lever pivot.

5. Switch according to claim 4 wherein one link of said toggle lever is pivoted at a fixed point.

6. The switch according to claim 3 wherein said rotatable drive crank is articulated to a link pivoting about a fixed pivot and pivoted by said mobile parts of said solenoid.

7. The switch according to claim 3 including a link connected by a first articulated coupling to said mobile parts of said solenoid and by a second articulated coupling to said drive crank of said cartridge.

8. The switch according to claim 7 wherein said second articulated coupling is demountable from said drive crank.

9. The switch according to claim 1 further comprising:

means for mechanically connecting said contact-holder and said tripping mechanism and means for mechanically connecting said contact-holder to mobile parts of said solenoid, said means enabling independent coupling of said tripping mechanism or said mobile parts of said solenoid to said contact-holder to enable independent operation as a contractor or as a circuit-breaker.

10. The switch according to claim 9 wherein said contact-holder is mechanically connected to said tripping mechanism by a toggle lever and said mobile parts of said solenoid operate on the toggle lever pivot through an articulated and/or sliding coupling enabling independent operation as a contactor or as a circuit-breaker.

11. The switch according to claim 10 wherein said sliding coupling comprises a slideway in said link in which said toggle lever pivot slides.

12. The switch according to claim 11 wherein said slideway is open to enable demounting of the assembly.

13. The switch according to claim 1 including a protection module.

14. A switch apparatus comprising:

a cartridge having an exterior casing, comprising:

a contact holder mounted within the exterior casing of the cartridge and rotatable therein;

a contact bridge housed within said contact holder for forming a switch having two ends being rotatable about a central axis within the contact holder; and a spring mounted between said contact holder and said contact bridge for applying a spring force against the contact bridge and limiting the rotation of the contact bridge within the rotating contact holder;

an electromagnet comprising:

a coil connectable to an external electrical supply for creating variable magnetic fields in response to said external electrical supply;

a fixed magnetic circuit forming a magnetic field in the direction of said variable magnetic fields created by the coil; and a mobile magnetic circuit being movable in relation to the coil and the fixed magnetic circuit;

contacts extendable into said cartridge and positioned adjacent said ends of said contact bridge, said contact bridge having an open position when said ends are not in contact with said contacts, and having a closed position completing an electrical connection when said contact bridge rotates about said axis and said ends contact said contacts;

a tripping mechanism able to operate independently of the mobile magnetic circuit on the opening contact bridge;

a linkage means for linking the mobile magnetic circuit to said contact holder and for linking the tripping mechanism to said contact holder; and wherein, said contact bridge is switched between said open and said closed positions when said linkage means rotates said contact holder based on a movement of said mobile magnetic circuit causing the contact bridge to rotate with the contact holder to switch between on and off positions, and said contact bridge rotating with respect to the contact holder when the contact bridge is forced against the springs toward said on position and when the contact bridge is driven with the help of the springs toward said off position.

15. The switching apparatus according to claim 14, wherein:

said contact holder forms a separate unit from said cartridge and is slidably mounted within said cartridge.

16. The switching apparatus according to claim 15, wherein:

said contact bridge is integrally formed with said contact holder.

17. The switching apparatus according to claim 16, wherein the linkage means further comprises:

a drive crank connected to the contact holder for rotating said contact holder within said cartridge and causing said contact bridge to switch between said open and closed positions.

18. The switching apparatus according to claim 17, further comprising:

a tripping mechanism connected to the linkage means for causing the linkage means to hold the contact bridge in an open position.

19. The switching apparatus according to claim 18, wherein:

said tripping mechanism causes the linkage means to move the mobile magnetic circuit away from any magnetic influences of the fixed magnetic circuit and the solenoid cannot cause the contact bridge to switch.

20. The switching apparatus according to claim 14, wherein the linkage means comprises:

a first link being elongated having one end rotatably connected to a fixed point and another end forming a pivot point;

a second link being elongated and having a first end connected to said pivot point of said first link;

a drive crank holding the contact holder and contact bridge about said central axis of said contact bridge and engaged with a second end of said second link opposite said pivot point; and wherein, said mobile magnetic circuit of said solenoid acts on said pivot point to cause the second link to drive the drive crank and rotate said contact holder, causing said contact bridge to rotate between said open and closed positions.

21. The switching apparatus of claim 20, wherein said second link further comprises:

an open portion at said second end for allowing the second link to be disengaged from the drive crank and allowing the cartridge to be removed from said switching apparatus.

* * * * *

UNITED STATES PATENT AND TRADEMARK OFFICE

CERTIFICATE OF CORRECTION

PATENT NO. : 5,534,832
DATED : July 9, 1996
INVENTOR(S) : Pierre DUCHEMIN, et al.

It is certified that error appears in the above-indentified patent and that said Letters Patent is hereby corrected as shown below:

On the title page, Item [75], the 1st Inventor's place of residence should read:

-- [75] Fourqueux --

Signed and Sealed this

Eighth Day of October, 1996

*Attest:*

*Attesting Officer*

BRUCE LEHMAN

*Commissioner of Patents and Trademarks*